United States Patent [19]

Canfield et al.

[11] 4,275,297

[45] Jun. 23, 1981

[54] ELECTRO-OPTICAL STRAND DETECTOR

[75] Inventors: Sheldon A. Canfield, Newark; Richard H. Pierce, Columbus; Kenneth L. Rapp, Granville, all of Ohio

[73] Assignee: Owens-Corning Fiberglas Corporation, Toledo, Ohio

[21] Appl. No.: 63,295

[22] Filed: Aug. 2, 1979

[51] Int. Cl.[3] ..... H01J 5/02

[52] U.S. Cl. ..... 250/239

[58] Field of Search ..... 250/561, 239; 19/0.21, 19/0.25; 28/187; 57/81; 66/161; 139/273 A; 242/37 R

[56] References Cited

U.S. PATENT DOCUMENTS 4,166,948 9/1979 Steffen ..... 250/223 R X

*Primary Examiner*—David C. Nelms
*Assistant Examiner*—Darwin R. Hostetter
*Attorney, Agent, or Firm*—Ronald C. Hudgens; Philip R. Cloutier; Greg Dziegielewski

[57] ABSTRACT

In an electro-optical strand motion detecting device the improvement comprises an optically transparent tubular shield surrounding the path of said strand at said sensor.

7 Claims, 3 Drawing Figures

ELECTRO-OPTICAL STRAND DETECTOR

TECHNICAL FIELD

The present invention disclosed herein provides apparatus for an improved electro-optical strand motion detection system.

BACKGROUND ART

The need for a reliable and efficient strand detection system is well known in the textile industry. Many of the prior art devices use a light source and reflected light from the strand to actuate a light sensor and provide a strand presence signal. One such prior art device is U.S. Pat. No. 4,010,908 which discloses a guide for a filament or strand and a fiber optic system for supplying light to the guide and for receiving light reflected from the strand. Other examples of using reflected light to sense the presence of a strand are shown in British Pat. Nos. 1,124,590 and 779,548.

The strand detection system disclosed in commonly assigned U.S. patent application Ser. No. 940,068 filed on Sept. 7, 1978, for Sheldon A. Canfield discloses an optical sensor unit having a solid state light source and light detector. The sensor is focused at the outer periphery of a pathway through which the strand travels.

One problem with such a system has been the build-up of fuzz around the sensor that can disable the system.

DISCLOSURE OF THE INVENTION

In an electro-optical strand sensor, the improvement comprises an optically transparent tubular shield surrounding the strand path at the sensor wherein the tubular shield is fluidically sealed at both ends to provide a partially sealed and self-cleaning electro-optical strand detection system.

BEST MODE OF CARRYING OUT THE INVENTION

Figure 1:
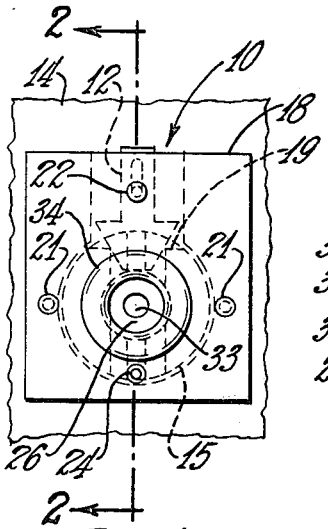
FIG. 1 is a rear elevational view of the strand detection system according to the principles of this invention.

As shown in the drawings, strand detection assembly 10 contains an optical sensor or sensing means 12 which can be of the type disclosed in the aforementioned pending U.S. application Ser. No. 940,068 filed on Sept. 7, 1978, which is hereby incorporated by reference. The basic operational principles involved and corresponding electrical systems correspond to those set forth in said application.

Sensor 12 is positioned between plate or main body 14 and first member or exit block 18 with sensor 12 being located in groove 19 of block 18.

Figure 2:
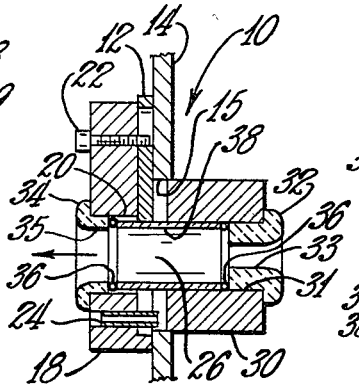
FIG. 2 is a sectional view of the apparatus shown in FIG. 1 taken along view 2—2.
Figure 3:
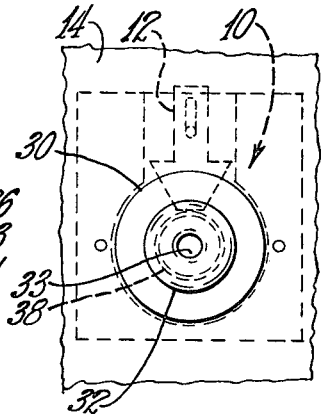
FIG. 3 is a front elevational view of the apparatus shown in FIG. 1.

Hole 15 of plate 14 is axial aligned with aperture 20 of block 18 to form passageway 26 through which the strand passes right to left as shown in FIG. 2.

Block 18 is securely fastened to plate 14 by means of fasteners 22 and 21. Fastener 21 also serves to locate and align sensor 12 within groove 19 such that the sensor is properly focused at passageway 26 as will be explained later herein. On the opposite side of plate 14 from exit block 18, entrance block or second member 30 is securely positioned within hole 15 by any suitable conventional means such as an adhesive. Roll pin 24 serves to align blocks 18 and 30 to prevent relative rotation therebetween.

First ceramic guide eye 32 is securely located within aperture 31 of entrance block 30 by any suitable means such as an adhesive. Second ceramic guide eye 34 is also securely fastened within aperture 20 of exit block 18. Passageway 33 of first ceramic guide 32 and passageway 35 of second ceramic guide 34 are in communication with passageway 26 to permit the advancement of the strand therethrough.

Intermediate said ceramic guides 32 and 34, an optically transparent tubular shield 38 is located at the zone of focus of sensor 12 with the tubular shield 38 surrounding and defining the path along which the strand advances at that point.

Between tubular shield 38 and each of ceramic guides 32 and 34, an O-ring or fluid sealing means 36 is positioned to provide a fluidic seal for the overall passageway formed by and between the ceramic guide eyes. As shown in FIG. 2, passageway 33 is somewhat smaller than passageway 26 but it is preferred that passageway 35 be of approximately the same internal diameter as passageway 26 to provide a somewhat self-cleaning system.

With the utilization of a textile strand composed of glass filaments, it is preferred that the ceramic guides 32 and 34 be made from a material such as "Alsimag". And it has been found that shield 38 can be comprised of optical quality Pyrex having a wall thickness of 0.5 mm$\pm$0.01 mm when used in conjunction with the solid state optical sensor such as the Optron Model No. OPP-125A.

If the wall thickness is increased, for example to approximately 1 mm a more powerful sensor unit may be required for acceptable results, and the geometry of the system may have to be changed to achieve the proper focus.

Textile rovings comprised of a plurality of glass filaments generally has a binder or size coating thereon which, in addition to the other dust and particulate matter, tends to collect in the passageway of the strand detection system. Although the fuzz is generally swept away by the advancing strand according to this design, the adhesiveness of the binder may cause the binder to adhere to the wall of the tubular shield. With a fluidically sealed system as herein described, the assembly can be cleaned with a suitable solvent without contacting the sensor 12. Without the shield 38, the fuzz and binder would tend to collect within the light passageways of the sensor itself.

While in principle, the insertion of an adequately hard, transparent, and infinitesimally thin septum or shield would perform the desired task, reality requires a finite thickness to provide ruggedness. As such, it is necessary to consider the optical behavior of the shield and the dimensional relationships between the sensor, shield and passageway. The sensor 12 is positioned such that the confocal region of the illumination source and photo detector or sensor 12 falls within the bore of the tubular shield 38 and immediately adjacent or close to the wall thereof. Obviously, the shielded system, as disclosed herein, requires a slight adjustment in sensor positioning to accommodate the curved tubular wall which acts as a lens refracting the entering and emerging light rays.

United States Patent [19]

Wykes et al.

[11] 4,275,298

[45] Jun. 23, 1981

[54] METHOD OF AND APPARATUS FOR DETERMINING THE PROPORTION OF AT LEAST ONE MATERIAL IN A MOVING MIXTURE OF MATERIALS

[75] Inventors: John S. Wykes, Allenton; Ian Adsley, Branston, both of England

[73] Assignee: Coal Industry (Patents) Limited, London, England

[21] Appl. No.: 911,247

[22] Filed: May 31, 1978

[30] Foreign Application Priority Data

May 31, 1977 [GB] United Kingdom ..... 22941/77

[51] Int. Cl.[3] ..... G01V 5/00; G01N 23/00; G01T 1/20

[52] U.S. Cl. ..... 250/255; 250/359; 250/367; 250/253

[58] Field of Search ..... 250/253, 255, 328, 303, 250/367, 366, 368, 361 R, 364, 359; 209/576, 589, 592, 593

[56] References Cited

U.S. PATENT DOCUMENTS

| | | | |
|---|---|---|---|
| 2,717,693 | 9/1955 | Holmes | 250/303 |
| 3,007,052 | 10/1961 | Hickman et al. | 250/359 |
| 3,237,765 | 3/1966 | Gaudin et al. | 209/589 |
| 3,445,651 | 5/1969 | Starnes | 250/359 |
| 3,732,420 | 5/1973 | Brunnett et al. | 250/252 |
| 3,882,309 | 5/1975 | Paap | 250/367 |
| 3,898,463 | 8/1975 | Noakes | 250/367 |
| 4,064,440 | 12/1977 | Roder | 250/367 |
| 4,118,623 | 10/1978 | Fertl et al. | 250/253 |
| 4,158,773 | 6/1979 | Novak | 250/368 |

FOREIGN PATENT DOCUMENTS

| | | | |
|---|---|---|---|
| 2271880 | 12/1975 | France | 209/589 |
| 7707065 | 12/1977 | Netherlands | 250/361 R |
| 939537 | 10/1963 | United Kingdom | 250/328 |
| 982763 | 10/1965 | United Kingdom | 250/328 |
| 379891 | 4/1973 | U.S.S.R. | 250/255 |

*Primary Examiner*—Alfred E. Smith
*Assistant Examiner*—Carolyn E. Fields
*Attorney, Agent, or Firm*—James C. Wray

[57] ABSTRACT

The proportion of a radioactive material in a moving mass of material is determined with a sensor which derives an output signal proportional to the mass of radioactive material. The output signal is calibrated against known reference values to give a quantitative value of mass. The sensor includes a plurality of scintillation crystals. Problems associated with inhomogeneity of material distribution are overcome by averaging the sensed radiation over a time period.

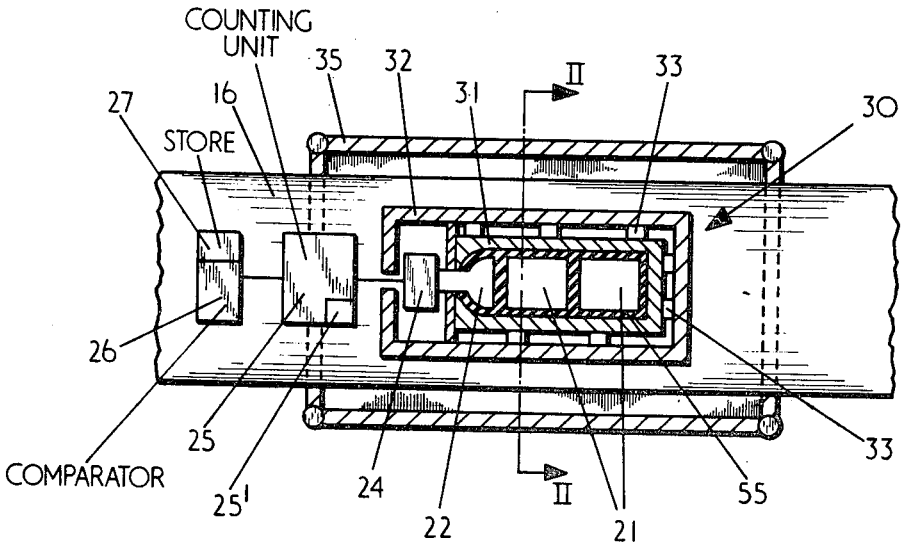

8 Claims, 9 Drawing Figures